US006370734B1

(12) United States Patent
Ryan

(10) Patent No.: US 6,370,734 B1
(45) Date of Patent: Apr. 16, 2002

(54) SHOE INSERT FOR RAIL CAR SLIDING DOORS

(75) Inventor: Walter S. Ryan, Mercer, PA (US)

(73) Assignee: Pennsylvania Rail Car Company, Mercer, PA (US)

( * ) Notice: Subject to any disclaimer, the term of this patent is extended or adjusted under 35 U.S.C. 154(b) by 0 days.

(21) Appl. No.: 09/692,984

(22) Filed: Oct. 23, 2000

(51) Int. Cl.[7] ..... A47H 15/00
(52) U.S. Cl. ..... 16/93 R; 16/96 R; 16/106
(58) Field of Search ..... 16/93 R, 96 R, 16/97, 98, 101–106; 49/410, 411, 425, 426

(56) References Cited

U.S. PATENT DOCUMENTS

| | | | | |
|---|---|---|---|---|
| 3,033,285 A | | 5/1962 | Banner | |
| 3,106,000 A | | 10/1963 | Beauchamp | |
| 3,956,854 A | | 5/1976 | Yamamoto | |
| 4,064,592 A | | 12/1977 | Riegelman et al. | |
| 4,178,857 A | * | 12/1979 | Madland | 16/96 R |
| 4,404,771 A | * | 9/1983 | Murase et al. | 16/105 |
| 4,457,046 A | | 7/1984 | Vater | |
| 4,633,615 A | | 1/1987 | Moose | |
| 4,639,970 A | | 2/1987 | Adams | |
| 5,148,630 A | * | 9/1992 | Llorens | 16/100 |
| 5,165,142 A | | 11/1992 | Pilsbury | |
| 5,598,606 A | * | 2/1997 | Jacobs | 16/93 R |
| 5,678,280 A | * | 10/1997 | Haab et al. | 16/96 R |
| 5,884,361 A | * | 3/1999 | Richardson et al. | 16/102 |

* cited by examiner

*Primary Examiner*—Chuck Y. Mah
(74) *Attorney, Agent, or Firm*—Harpman & Harpman

(57) ABSTRACT

A wear guide insert for use in rail car door support carriages for sliding rail car doors. Wear guide inserts are positioned in the wheel carriage openings for intermediate engagement with a supporting track on which the wheel carriages travel. The inserts are of a self-lubricating synthetic resin material that acts as guide bearing surfaces for the wheel carriages maintaining the carriages on the support tracks as the rail car doors are slid open and closed.

6 Claims, 4 Drawing Sheets

SHOE INSERT FOR RAIL CAR SLIDING DOORS

BACKGROUND OF THE INVENTION

1. Technical Field

This invention relates to railroad rail cars and more specifically to sliding rail car doors that are used to gain access to the rail cars. Wheeled carriages are used to support the doors and allow for sliding action along a guide and support track mounted on the lower doorsill of the boxcar.

2. Description of Prior Art

Prior art devices of this type have relied on wheel carriage housings to act as bearing guide surfaces. The wheeled carriage housings are cast with a reinforced wear surface area within that selectively engages the respective sides of the guide track holding the carriage assembly wheels on the track, see for example U.S. Pat. No. 3,106,000 drawn to rollers for door of refrigeration and box cars. Other prior art patents have disclosed various roller guides utilized in other art applications, see for example U.S. Pat. Nos. 3,033,285, 3,956,857, 4,064,592, 4,457,046, 4,633,615 and 5,165,142.

All of the above referred to patents show a variety of different wheel track configurations most of which are drawn to analogous art of sliding doors, such as patio doors set forth in U.S. Pat. No. 4,633,615, sliding panels with an assembly showing rollers, a support track and guide element set forth in U.S. Pat. No. 4,639,970. Examples of track engagement guides associated with roller slide assemblies can be seen in U.S. Pat. No. 3,033,285 on a track and roller combination for sliding screen doors and in U.S. Pat. No. 3,956,854 on an apparatus for preventing detachment of horizontal rolling sashes of a window or the like.

Most of the devices have a wheeled carriage which is engageable on a track and utilizes secondary structures extending from the carriage to hold the carriage onto the track by selective frictional engagement on either side of the track as the doors move longitudinally therealong.

Applicant's device is directed towards railroad car door assemblies in which carriages are used to support a door and portions of the carriage housing are used as a retaining means against the guide track on which the rollers engage.

SUMMARY OF THE INVENTION

This invention is directed towards rail car doors track retaining devices wherein a wheel support carriage slideably engages a door support track on which the rail car door slides. Wear guide inserts of the invention are removably secured within the carriage housing at points of track engagement providing a self-lubricating synthetic resin slide bearing surface for the carriage.

DESCRIPTION OF THE PREFERRED EMBODIMENT

Figure 1:
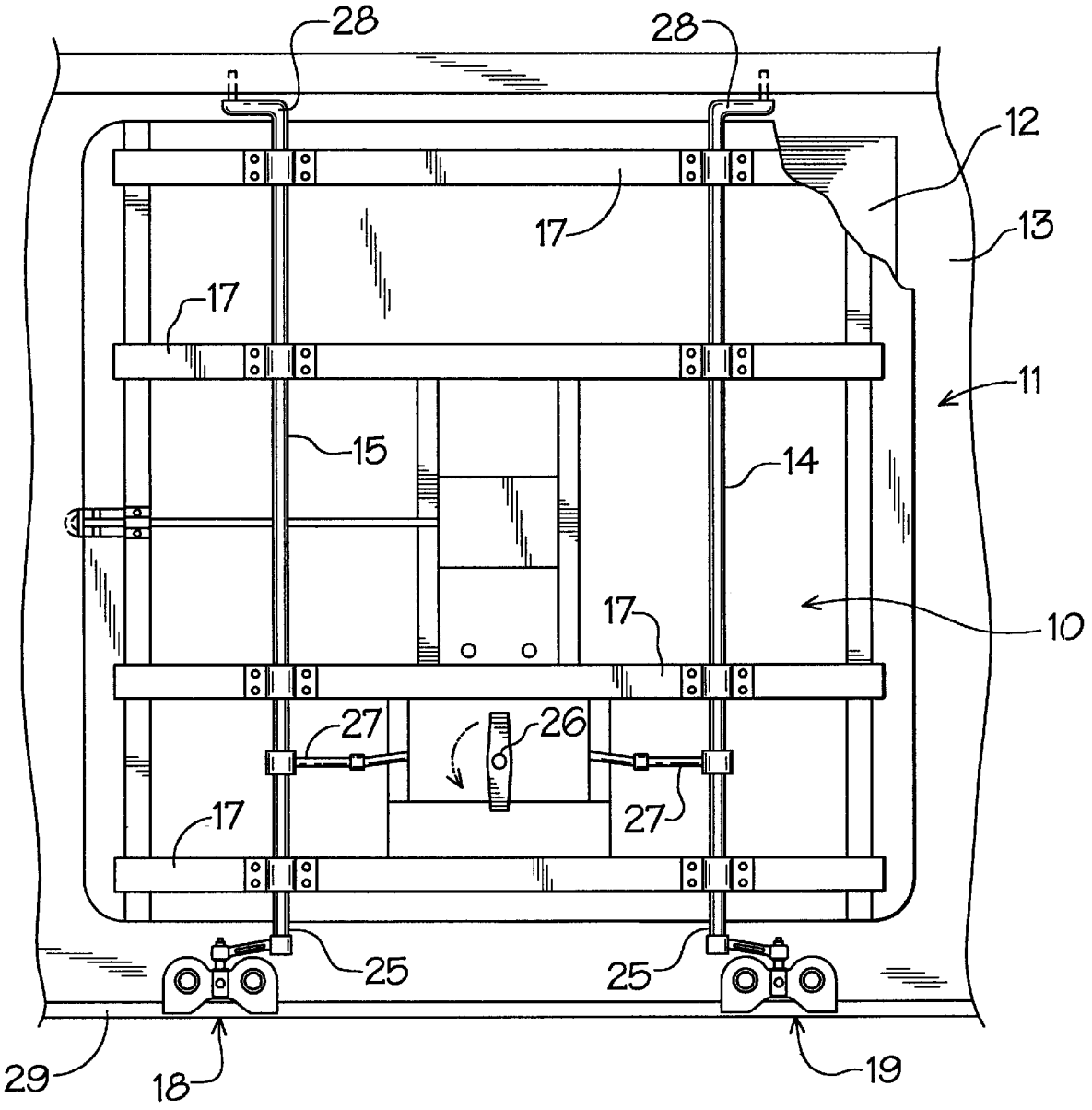
FIG. 1 is a side elevational view of a rail car door on a portion of a rail car illustrating the wheel support and guide assemblies in use.

Referring now to FIG. 1 of the drawings, a rail car door 10 can be seen slidably positioned on a railroad boxcar 11. The car door 10 overlies a boxcar opening 12 within a rail car side 13. The rail car door 10 has a pair of vertically aligned support bars 14 and 15 mounted thereon by a plurality of horizontally disposed spaced support brackets 17 which allow for the support bars 14 and 15 to rotate about their longitudinal axis.

Figure 2:
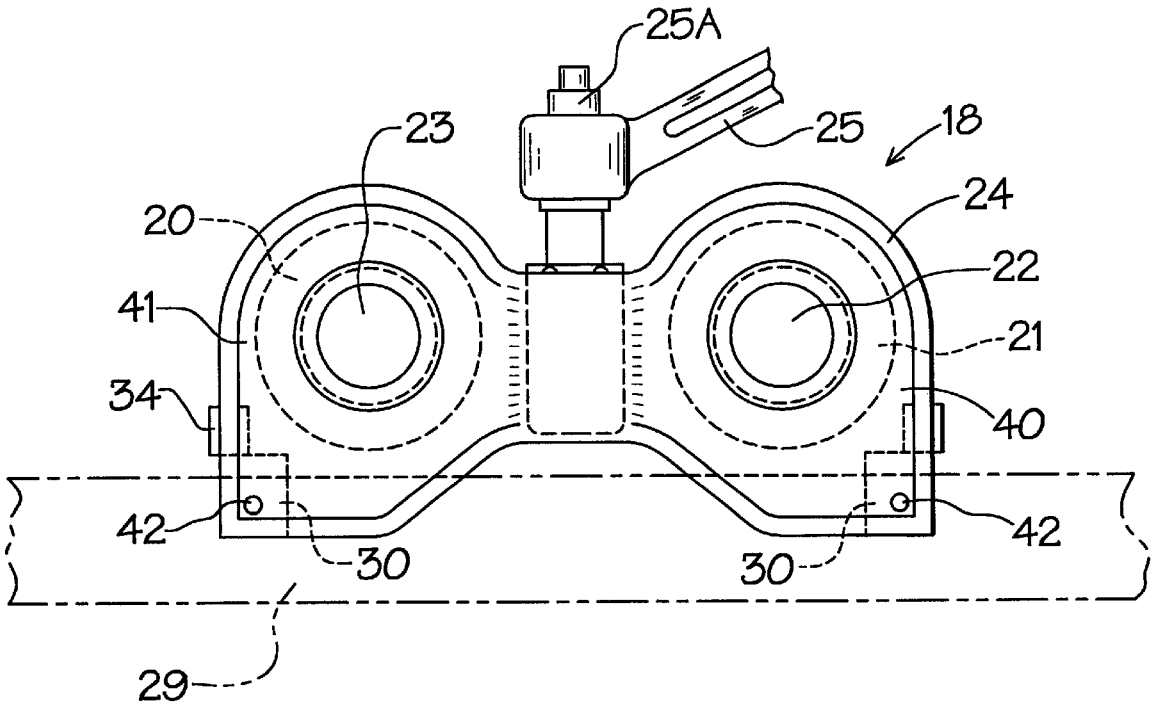
FIG. 2 is an enlarged side elevational view of the wheeled support guide carriage with the wear guide inserts of the invention installed within.
Figure 3:
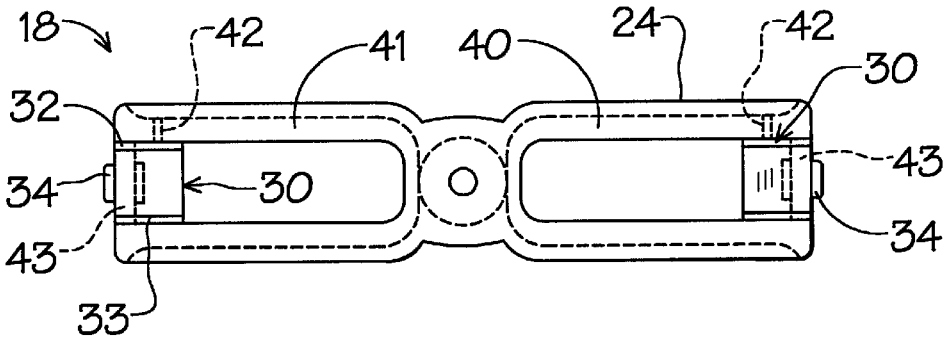
FIG. 3 is a bottom plan view of the wheel support and guide carriage assembly as seen in FIG. 2 of the drawings.
Figure 4:
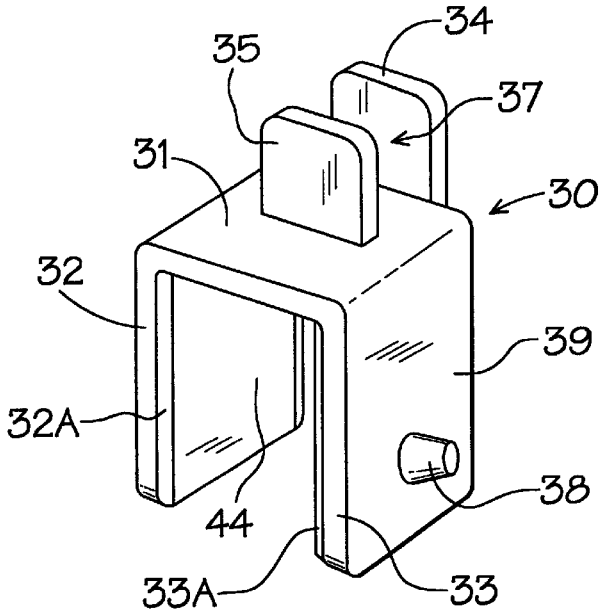
FIG. 4 is a perspective view of the wear guide insert of the invention.
Figure 5:
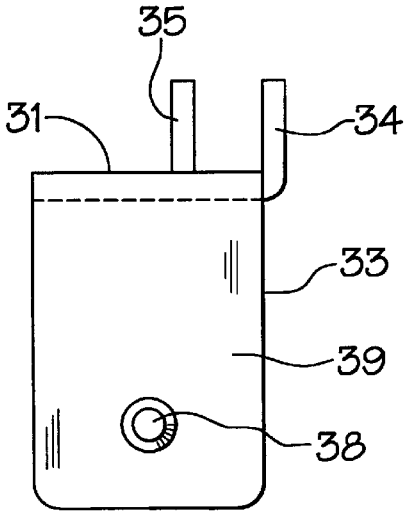
FIG. 5 is a side elevational view of the wear guide insert as seen in FIG. 4.
Figure 6:
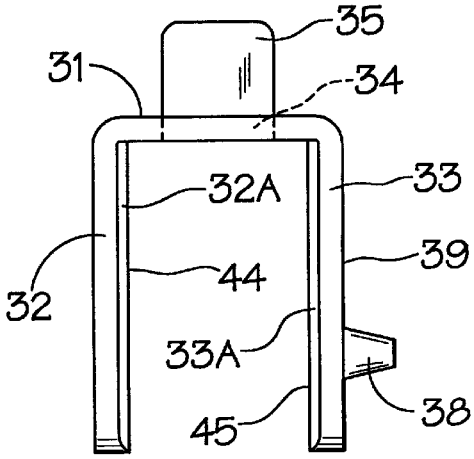
FIG. 6 is a front elevational view of the wear guide insert of the invention.
Figure 7:
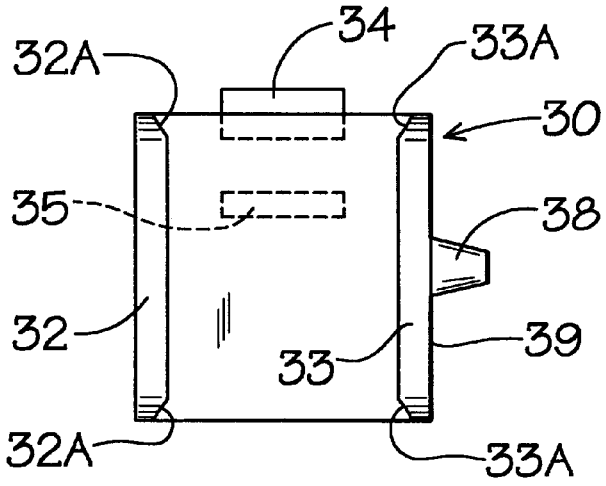
FIG. 7 in a bottom plan view of the wear guide insert as seen in FIG. 6 of the drawings.

The rail car door 10 is supported for lateral and longitudinal movement on roller carriages 18 and 19. Each of these carriages has a pair of track engagement rollers 20 and 21 (shown in broken lines) mounted on respective support bearing assemblies 22 and 23 within a carriage housing 24. Rod cranks 25 are secured to the lower end of the respective support bars 14 and 15 and are provided with spindles 25A which are respectively journaled into the rolling carriages 18 and 19 between the rollers 20 and 21, best seen in FIGS. 2 and 3 of the drawings.

Rotation of the support bars 14 and 15 is achieved via a handle assembly 26 that interconnects to the respective support bars 14 and 15 by levers 27 as will be well understood by those skilled in the art. The handle assembly 26, as hereinbefore described, rotates the support bars 14 and 15 on their longitudinal axis moving the rail car door 10 laterally initially (in) and (out) of the door opening 12 about a second pair of cranks 28 shown generally on their respective upper ends of the support bars 14 and 15. Once the rail car door 10 has been moved laterally out of the opening 12, it can then be moved longitudinally along a support track 29 on the rail car 11 upon which the roller carriages 18 and 19 are engaged.

Wear car inserts 30 of the invention, best seen in FIGS. 2–6 of the drawings, have, in this example chosen for illustration, a top portion 31 with a pair of horizontally spaced depending engagement flanges 32 and 33 extending therefrom. A pair of upstanding mounting tabs 34 and 35 extend respectively beside and from the top portion 31. The mounting tab 34 extends from the perimeter edge of the top portion 31, best seen in FIG. 5 of the drawings, while the mounting tab 35 extends from the upper flat surface of the top portion 31 in spaced parallel aligned relationship to the tab 34 defining a mounting area 37 therebetween. A retaining lug 38 extends from an outer surface 39 of the depending flange 33 for registration within the housing 24 of the respective roller carriage assemblies 18 and 19 as will be described in greater detail hereinafter.

Referring back now to FIGS. 2 and 3 of the drawings, the roller carriage's housing 24 has bifurcated portions 40 and 41 through which the guide track 29 extends as indicated by the broken lines in FIG. 2 of the drawings. Registration openings 42 in each side of the respective housing portions 40 and 41 allow for corresponding registration of the retaining lug 38 of the wear insert 30 thereby retaining the insert within the housings, as noted. The mounting tabs 34 and 35 fit over an end housing portion at 43 which defines track access openings respectively.

The wear insert 30 provides oppositely disposed track bearing surfaces 44 and 45 protecting the housing 24 from contact and associated wear. The wear insert 30 is preferably made of a synthetic resin bearing material that is self-lubricating to provide a durable long wearing bearing surface of a low frictional co-efficient.

Each of the depending flanges 32 and 33 are generally rectangular and have oppositely disposed beveled edge surfaces at 32A and 33A to assure a smooth engagement with the guide track 29.

Figure 8:
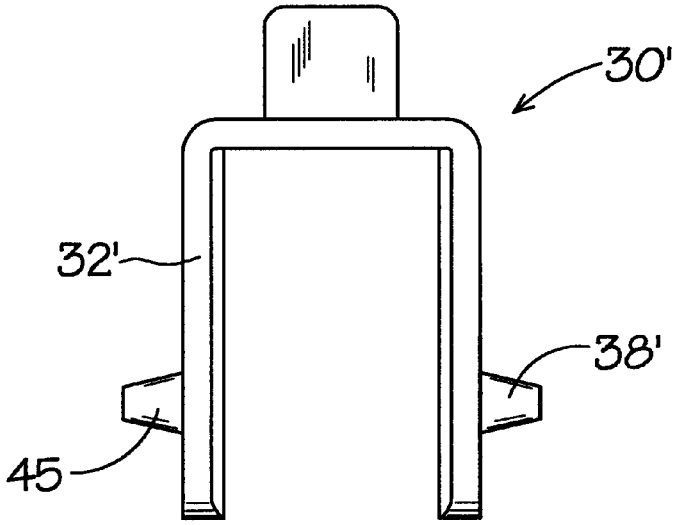
FIG. 8 is a front elevational view of an alternate form of the wear guide insert of the invention.

Referring now to FIG. 8 of the drawings, an alternate form of the invention can be seen indicated at 30' wherein a secondary interlocking lug 45 is formed on the opposite depending flange 32' and retaining lug 38'. This will provide additional registration service within a modified housing (not shown) having a second registration opening therein as will be evident and well understood by those skilled in the art.

It will thus be seen that a new and novel wear guide insert for railroad car roller carriages has been illustrated and described and it will be apparent to those skilled in the art that various changes and modifications may be made thereto without departing from the spirit of the invention.

Therefore I claim:

1. A wear guide insert adapted for installation in a rail car door carriage support assembly for selectively engaging a horizontal guide track on a rail car comprises, a monolithic U-shaped body member of relatively hard synthetic resin material, said body member having a top portion, a pair of oppositely disposed depending engagement flanges extending from said top portion adapted to engage the guide track for sliding and movement therealong, a pair of upstanding mounting tabs extending from said top portion of said body member engageable on a portion of said carriage support assembly, a registration lug extending from at least one of said depending engagement flanges.

2. The wear guide insert set forth in claim 1 wherein said mounting tabs extend at right angles from said top portion of said body member in transverse aligned relationship to said depending engagement flanges.

3. The wear guide insert set forth in claim 1 wherein each of said depending engagement flanges have longitudinally extending tapered edge portions facing said opposite engagement flange.

4. The wear guide insert set forth in claim 1 wherein said registration lug is spaced inwardly of a free end of said respective depending engagement flange for registration within an opening in said carriage support assembly.

5. The wear guide insert set forth in claim 1 wherein said U-shaped body member of relatively hard synthetic resin material has a low frictional bearing surface for ease of selective sliding contact with said guide track.

6. The wear guide insert set forth in claim 1 wherein said rail car door carriage support assembly defines an open ended horizontal passageway and wherein said U-shaped body member being dimensioned to fit within said door carriage support assembly thereabout.

* * * * *